United States Patent [19]

Goessler et al.

[11] Patent Number: 4,511,789

[45] Date of Patent: Apr. 16, 1985

[54] HEATING ELEMENT, PARTICULARLY RADIANT HEATING ELEMENT FOR HEATING GLASS CERAMIC PLATES

[75] Inventors: Gerhard Goessler, Oberderdingen; Eugen Wilde, Knittlingen, both of Fed. Rep. of Germany

[73] Assignee: E.G.O. Elektro-Gerate Blanc u. Fischer, Fed. Rep. of Germany

[21] Appl. No.: 528,157

[22] Filed: Aug. 31, 1983

[30] Foreign Application Priority Data

Sep. 16, 1982 [DE] Fed. Rep. of Germany ..... 3234349
Apr. 21, 1983 [DE] Fed. Rep. of Germany ..... 3314501

[51] Int. Cl.[3] ..... H05B 1/02

[52] U.S. Cl. ..... 219/446; 219/449; 219/464; 219/486; 219/466

[58] Field of Search ..... 219/445, 446, 448, 449, 219/451, 452, 460, 462, 463, 464, 466, 486, 496, 507, 511; 338/134

[56] References Cited

U.S. PATENT DOCUMENTS

| | | | |
|---|---|---|---|
| 2,419,083 | 4/1947 | Myers | 219/446 |
| 2,450,399 | 9/1948 | Sheider | 219/446 |
| 2,906,845 | 9/1959 | Turner | 219/449 X |
| 3,257,544 | 6/1966 | Benjamin, Jr. | 219/486 |
| 4,327,280 | 4/1982 | McWilliams | 219/464 |
| 4,347,432 | 8/1982 | Gössler | 219/449 |
| 4,350,875 | 9/1982 | McWilliams | 219/449 |
| 4,371,780 | 2/1983 | Gössler et al. | 219/446 |
| 4,393,299 | 7/1983 | McWilliams | 219/446 |

FOREIGN PATENT DOCUMENTS

| | | |
|---|---|---|
| 235422 | 8/1964 | Austria . |
| 2118407 | 10/1972 | Fed. Rep. of Germany . |
| 2221874 | 11/1973 | Fed. Rep. of Germany . |
| 3007037 | 9/1981 | Fed. Rep. of Germany . |

*Primary Examiner*—Volodymyr Y. Mayewsky
*Attorney, Agent, or Firm*—Steele, Gould & Fried

[57] ABSTRACT

An electrical radiant heating body has two concentric heating zones with independently operable heating resistors. On only switching in the central zone, the associated heating resistor has a very high power which, on connecting in the outer zone, can be reduced by the connection in series of a heating resistor in the outer zone, so that there is a uniform heating surface loading for the total heating surface.

The thermometer probe of a thermal cut-out projects over the heating surface and has two contacts operating at different temperatures, one of them being a change-over contact.

14 Claims, 2 Drawing Figures

HEATING ELEMENT, PARTICULARLY RADIANT HEATING ELEMENT FOR HEATING GLASS CERAMIC PLATES

BACKGROUND OF THE INVENTION

1. Field of the Invention

The invention relates to a heating element, particularly a radiant heating element for heating glass ceramic plates in cookers with at least two separately operable heating zones with electrical heating resistors.

2. Prior Art

German Auslegeschrift 30 07 037, corresponding to U.S. Pat. No. 4,347,432 discloses a heating element with two concentric heating zones. It is desirable to greatly increase the power of the central heating zone, in order to achieve a short initial cooking or boiling time in the case of small cooking vessels. However, a power increase above a certain limit, e.g. 2100 W, is not possible, if the control is carried out with a timing power control device. The high making and breaking currents and the necessary switching rate lead to inadmissible loading of the mains. If the power of the central heating zone is raised at the expense of the other zones, an unfavorable heat distribution occurs on interconnection. It is also difficult to manufacture low power heating resistors for use at higher voltages, particularly 380 V, because the wires become too thin and are difficult to fix to the insulating body of the heating element.

SUMMARY OF THE INVENTION

The object of the invention is to provide a heating element which, despite increased power, ensures a uniform heat distribution when switching on both heating zones, while being easy to manufacture.

According to the invention this object is achieved in that a heating resistor of one of the heating zones can be connected in series with the heating resistor of the other heating zone.

Thus, in the only heating zone which can be switched on independently, usually the central zone, it is possible to operate at a high power with a high specific heating surface loading, while operating with a uniform power distribution when switching over to the total heating surface of the heating element. For this purpose, according to a preferred embodiment, the series resistor in the other, e.g. outer heating zone can be provided in addition to a further heating resistor, which can e.g. be connected in parallel with the central heating resistor, which can alone be switched on independently. The power distribution can be set in a random manner. Thus, in the case of operation with two heating zones, the specific heating surface loading on the central zone can be lower than that of the outer zone. This embodiment is particularly suitable for heating elements, which deliberately has two varyingly large or differently designed heating zones, which can be differently connected in in accordance with the pot shape or size.

The arrangement of two heating zones, which are then virtually inseparable from one another in operation, can also be advantageous in the case of a heating element, in which the switching on of one heating resistor only leads to a power increase during an initial cooking phase or the like. For this purpose, according to the invention, the series heating resistor can be preconnected to reduce to normal power an increased initial cooking power provided in the other heating resistor. If the series heating resistor closely surrounds a central heating zone containing the other heating resistor, a total cooking surface is obtained, which is often not significantly larger than that taken up by the only heating resistor which can be switched on independently. Nevertheless, in an initial cooking area an increased and more concentrated power can be obtained, which also leads to an increased power throughput in conjunction with the cooking vessels which are still cold in this state and the consequently greater cooling of the glass ceramic plate. The switched-on total cooking surface has then a lower total power than does the central zone alone. The outer heating zone can be integrated into a total winding in that it takes in the outer turn, or in special cases also the inner turn or double turn of the spirally arranged turns of both heating zones.

German Auslegeschrift 30 07 037, corresponding to U.S. Pat. No. 4,347,432, also shows, in connection with heating elements with two heating zones, corresponding to the thermal action on the temperature probe of a thermal cut-out limited to only a specific area in the case of one heating zone, that it should be equipped with switches having different response temperatures, in order to achieve a disconnection with a comparable surface temperature of the glass ceramic plate. It is then necessary to lay four leads between the control device and the heating elements and to construct the switch for the second heating zone as a double switch. This need is obviated if, according to a particularly preferred embodiment of the invention, a thermal cut-out with two contacts having different response temperatures is provided, whereof that with the lower response temperature is constructed as a changeover contact. On reaching the lower set response temperature, the changeover switch switches the heating resistor, which is to be individually switched on, from current branch upstream of the switch to another current branch downstream of the switch, so that it is switched off alone, but on switching on both heating zones, it is switched on again with its power possibly reduced by the series resistor. This circuit only requires three hotplate leads and a single switch for switching in the second heating zone.

BRIEF DESCRIPTION OF THE DRAWINGS

Further advantages and features of the invention can be gathered from the description and the drawings, wherein.

DETAILED DESCRIPTION OF THE PREFERRED EMBODIMENTS

Figure 1:
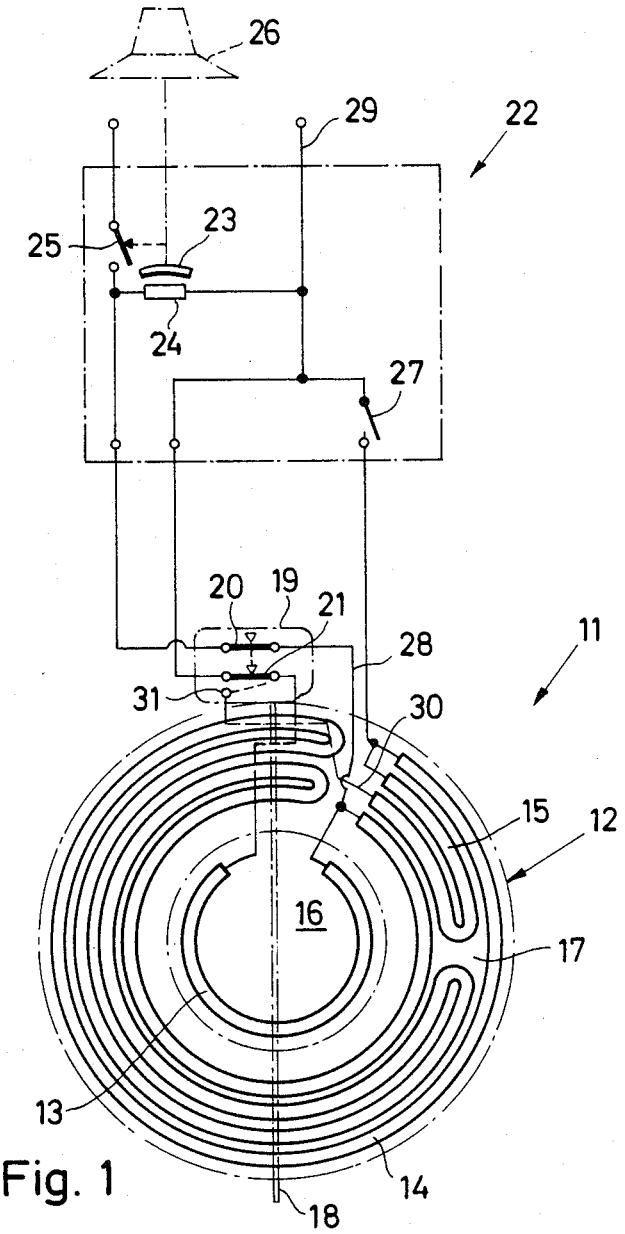
FIGS. 1 and 2 are each diagrammatic plan views and circuit diagrams of alternative embodiments of a heating element and its control system according to this invention.

A radiant heating element 11 for a glass ceramic hotplate of a cooker is shown in the drawings. Heating element 11 has heating resistors 13, 14, 15, which comprise wire coils fixed to the surface of an insulating support 12. The wire coils are in the form of arcs, spirals or double spirals. They are arranged in two heating zones 16, 17. The central heating zone 16 contains the heating resistor 13 and is surrounded by an annular heating zone 17, with a much larger overall surface, in which is provided the main heating resistor 14 in the form of a circular loop with four parallel coils. However, between the two outer strands, over a sector of e.g. 60°, the heating resistor 15 is arranged in the form of a single, bent loop, where the main heating resistor 14 is supplemented on the four strands.

A rod-like temperature sensor of probe 18 of a thermal cut-out 19 projects diametrically over both heating zones 16, 17, and protects the glass ceramic plate from dangerous overheating by switching off the heating resistors. The thermal cut-out contains two contacts 20, 21, which are adjusted to different response points and whereof contact 21 is a changeover contact.

The power is controlled by a timing power control device 22, which contains a bimetallic strip 23, heated by a control heating resistor 24 and acting on a switch 25. The power which is consequently timed with different relative on-off times can be adjusted by means of a setting knob 26. The outer heating zone 17 can be switched in by means of an additional switch 27.

Power is supplied to heating element 11 by means of switch 25 and the contact 20 of thermal cut-out 19, which is adjusted to a higher temperature. Heating resistors 14 and 13 are connected on this branch 28. The other end of the central heating resistor 13 passes to the other contact 21 of the thermal cut-out and can be branched there on two connections, connected on the one hand with the other main pole 29 and on the other hand with a lead 30 to the series heating resistor 15. In each case the other ends of the heating resistors 14, 15 are together connected to switch 27.

The function of the heating element is as follows (FIG. 1). When switch 27 is open, only the central heating zone 16 is operated, e.g. if only a small pot has to be heated. On switching on the power control device by means of setting knob 26, switch 25 is closed and the central heating zone is operated at full power, which can represent e.g. approximately 40% to 50% of the total power of the heating element by means of the closed contact 20 of thermal cut-out 19 and the changeover contact 21 which is in the position shown in the drawing. This leads to a relatively rapid heating of the small cooking vessel. The central heating zone 16 only heats the central part of thermometer probe 18 to the full temperature, so that the resulting expansion of this probe is less than corresponds to the temperature sensor heated over its full length. As the changeover contact is set to a lower response point, heating resistor 13 still switches off at the preset limit temperature. The changeover contact then switches over to contact 31.

If the outer heating zone 17 is connected in by means of the additional switch 27, then in the case of a previously cold heating element, i.e. contact 21 not responding, then the unreduced power of the heating resistor 13, e.g. 900 W and the power of heating resistor 14, e.g. 1400 W, is switched on, so that a high total power is switched on for initial cooking purposes. As now the complete thermometer probe length is completed, contact 21 is switched over much earlier, i.e. at a temperature well below the limit temperature. By switching to contact 31, the heating resistor 15 is now connected in series with heating resistor 13, so that the power of resistor 13 is considerably reduced, (e.g. 650 W), while the outer heating zone receives a small proportion of the power through the series heating resistor 15. Through the corresponding dimensioning of the heating resistors, the specific heating surface loads can be adapted to circumstances. However, in any case it is possible to achieve a uniform and, in the central area, possibly even a lower specific heating surface loading over the entire surface.

On reaching the limit temperature, contact 20 switches off total power and then switches it on again when the temperature drops.

Numerous variants to the represented embodiment are possible. Thus, for example, the arrangement of the heating resistors can differ. In place of the arrangement of heating resistor 15 limited to a ring segment, it could also be arranged e.g. as a turn, e.g. the inner turn running round the entire heating element. Here again the advantage is retained that through the series heating resistor not only is the power of the other heating zone reduced, but also the switch-in heating zone 17 receives additional power through the series heating resistor.

However, it is also possible to use this with an other than circular concentric arrangement, e.g. in the case of a rectangular heater with a central, circular cooking point and additional heating zones on either side. The elongated rectangular cooking surfaces are then mainly used for warming and consequently a uniform power distribution is particularly important.

The thermal cut-out described has the advantage that the described switching possibilities are possible with only a single additional switch 27 as a result of the reversing switch 21, because when the latter reaches the lower response temperature, heating resistor 13, which was previously switched on alone, is connected in parallel with heating resistor 14, with which is connected in series the series heating resistor 15. However, even without using the latter, this advantage is retained in the case of heating elements with two separately switchable heating resistors and a thermal cut-out with two different response temperatures. It is also possible, preferably while preconnecting in each case a series heating resistor, to individually or parallel connect several heating resistors for more than two heating zones.

Figure 2:
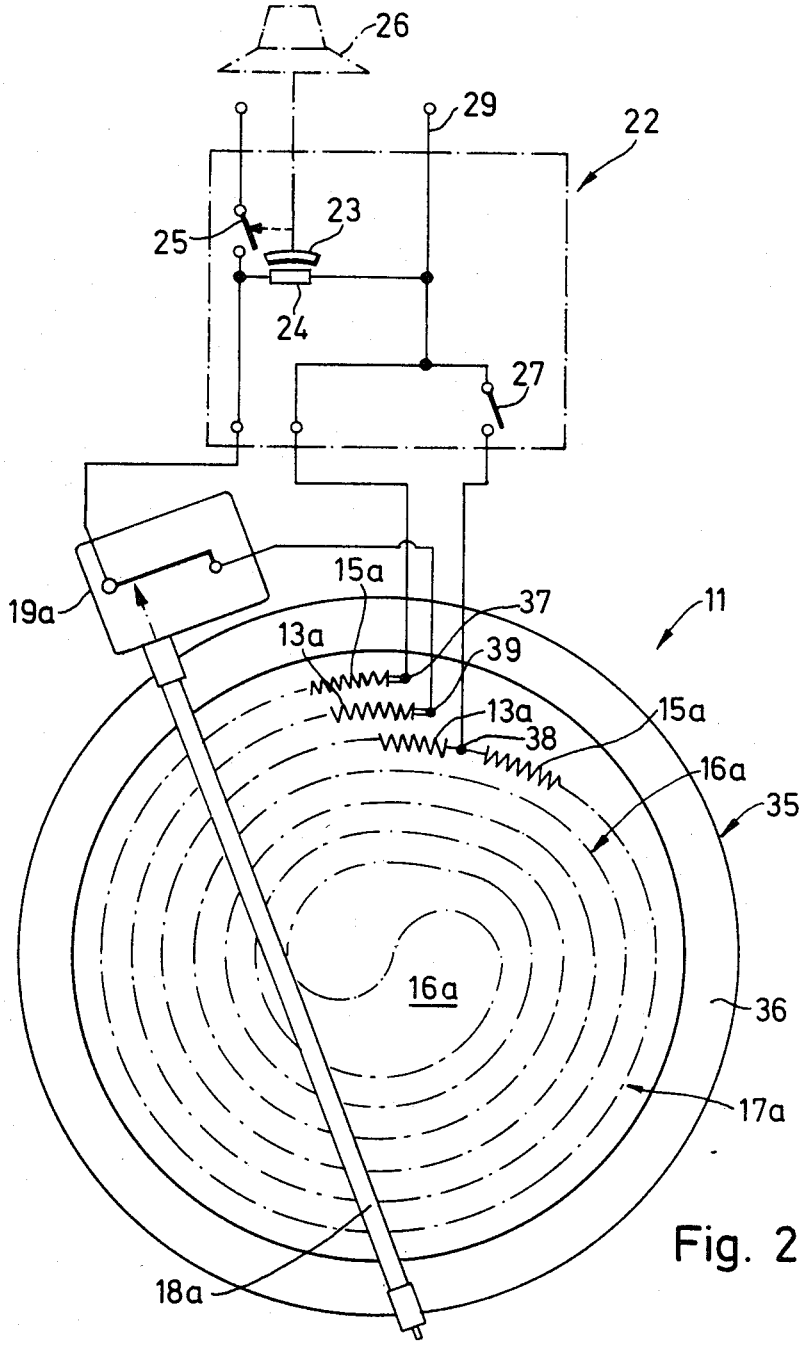

FIG. 2 shows a heating element in which, although there are two heating zones **16*a*, 17*a*, they are not as clearly separated as in FIG. 1. Unlike in the case of FIG. 1, they are not intended for heating pots of different sizes and instead are associated with cooking pots having a uniform size. Thus, the dish-shaped insulating body 35, in which the heating resistors 13*a*, 14*a* are arranged, has no internal subdivisions. Thus, it only has a rim 36**, engaging with the bottom of the glass ceramic plate and surrounding the common cooking point formed by the two heating zones.

With an identical construction of the control circuit 22 to that of FIG. 1 (the same parts carry the same reference numerals), the arrangement of the heating resistor is such that the inner heating resistor 13 takes up most of the surface, while the outer heating resistor **15*a* is virtually limited to the outer turn. Thus both heating elements are in the form of double spirals, i.e. a sprial with two parallel turns reversing in the center of the heating element. The outer heating resistor extends between a connection 37 and a tap 38, which is formed by a coupling pin between heating resistors 13*a*, 15*a*, whilst the central main heating resistor 13*a* is connected between a connection 39 on the inside of the outer double turn and tap 38**.

A thermal cut-out **19*a* is provided, whose rod thermometer probe 18*a* projects somewhat eccentrically over the two heating zones 16*a*, 17*a*. The thermal cut-out 19*a*** has only a single contact, which is opened on reaching the response temperature.

The function is as follows (FIG. 2). If switch 27 is closed, only heating resistor **13*a* is switched on and has a comparatively high power. It corresponds to an initial cooking power, i.e. a higher power than the heating element would have in the continuous operating state. The wire from which heating coil 13***a* is formed, can therefore be relatively thick, can be easily installed and is mechanically and thermally durable. This power is timed in accordance with the set power value, following the response of the power control device 23, 24, 25, If switch 27 is opened, then the previously short-circuited heating resistor 15*a* is connected in series with heating resistor 13*a*, so that both heating resistors now together have a lower power than heating resistor 13*a* alone. Thus, in the position, both heating zones 16*a*, 17*a* are connected in and a more uniformly distributed, but lower power is obtained, which is used for continuous cooking or boiling.

Although at a first glance it would appear to be absurd to limit the higher power to a smaller area, namely the inner heating zone 16*a*, and then with lower power to use the larger surface, namely both heating zones 16*a*, 17*a* together, in actual fact, apart from manufacturing advantages, operating advantages also occur. Although in the case of the initial cooking power the smaller radiation surface is available, tests have shown that the initial cooking time is not extended. Heating resistor 13*a*, which is relatively highly loaded when used alone, glows very rapidly, so that the dead time inherent in the heating element is significantly reduced. Moreover, in its area close to the edge, the thermal cut-out 19*a* is heated less rapidly and a somewhat delayed disconnection occurs, which is still admissible and shortens the initial heating time. On the cooking vessel side, the pronounced power concentration in the initial heating area is less critical, because in this area the food is still cold and has no tendency to initially boil or partly burn, whereas in the continuous cooking area, where this is critical, there is a comparatively lower power. The service life of the heating elements is surprisingly good. Despite the considerable loading of heating resistor 13*a* during the initial cooking phase, this does not lead to a reduction in the service life, because this time is usually very short. Switch 27 is preferably manually operated, but could also be operated thermally or by a timing mechanism.

What is claimed is:

1. A radiant heating element for heating glass ceramic plates in cookers, having first and second non-overlapping heating zones, the heating element comprising:

at least one electrical heating resistor disposed in each of the first and second heating zones;

means operable selectively for energizing the at least one heating resistor of the first heating zone independently of the at least one heating resistor in the second heating zone and for simultaneously energizing the at least one heating resistors in both the first and second heating zones, the at least one heating resistor of the first heating zone being thereby always energized during operation of the heating element; and, means for connecting at least one heating resistor of the second heating zone in series with the at least one heating resistor of the first heating zone, whereby operation of only the first heating zone provides more concentrated heating at a higher power level than simultaneous operation of both heating zones, simultaneous operation of both heating zones providing uniform heating at a lower power level.

2. A heating element according to claim 1, wherein the second heating zone surrounds the first heating zone.

3. A heating element according to claim 1, comprising at least two electrical heating resistors disposed in the second heating zone, at least one of which is series-connected to the at least one heating resistor of the first heating zone by the connecting means when both heating zones are energized.

4. A heating element according to claim 3, wherein the specific heating surface loading of the first heating zone and the series-connected heating resistor of the second heating zone is at least equal to the specific heating surface loading of the second heating zone.

5. A heating element according to claim 3, wherein the series-connected heating resistor forms a part of the periphery of the second heating zone.

6. A heating element according to claim 5, wherein the series-connected heating resistor of the second heating zone is disposed not to overlap the other heating resistors of the second heating zone.

7. A heating element according to claim 4, comprising means for energizing the at least one heating resistor of the first heating zone and the series-connected heating resistor of the second heating zone without energizing other heating resistors of the second heating zone, for reducing to normal power an otherwise increased initial cooking power provided by the first heating zone alone.

8. A heating element according to claim 7, wherein the first heating zone is substantially circular and the series-connected heating resistor of the second heating zone closely surrounds the first heating zone.

9. A heating element according to claim 8, wherein the series-connected heating resistor of the second heating zone is the outer turn of a heating coil in the form of a spiral-type winding.

10. A heating element according to claim 1, further comprising a thermal cut-out having a temperature sensor extending over both heating zones, the thermal cut-out provided with two switch contacts having higher and lower response temperatures relative to one another, the contact having the lower response temperature being a changeover contact.

11. A heating element according to claim 10, comprising main and supplemental electrical heating resistors in each heating zone, and wherein the changeover contact connects the main heating resistors of both heating zones in parallel in an initial cooking phase in one position, and on switching over, connects one heating resistor of the first heating zone in series with one heating resistor of the second heating zone.

12. A heating element according to claim 10, wherein the changeover switch contact is connected in a supply line to an associated heating resistor, is constructed as a reversing switch, and on reaching its response temperature, connects the heating resistor associated therewith in parallel with, in each case, a next heating resistor, the switch contact with the higher response temperature being connected in series with a common return line of all the electrical heating resistors.

13. A heating element according to claim 10, wherein the heating zones are concentrically arranged, and the switch contact with the lower response temperature is operatively associated with the at least one heating resistor of the inner heating zone.

14. A heating element according to claim 3, wherein the series-connected heating resistor forms part of the radial extension of the second zone.

* * * * *